US005625341A

United States Patent [19]

Giles et al.

[11] Patent Number: 5,625,341

[45] Date of Patent: Apr. 29, 1997

[54] MULTI-BIT EAS MARKER POWERED BY INTERROGATION SIGNAL IN THE EIGHT MHZ BAND

[75] Inventors: Olin S. Giles; Hubert A. Patterson, both of Boca Raton; Richard Frederick, Lighthouse Point; David B. Ferguson, Boca Raton, all of Fla.

[73] Assignee: Sensormatic Electronics Corporation, Deefield Beach, Fla.

[21] Appl. No.: 522,023

[22] Filed: Aug. 31, 1995

[51] Int. Cl.[6] ..... G08B 13/14

[52] U.S. Cl. ..... 340/572; 340/825.3; 340/825.54; 342/44

[58] Field of Search ..... 340/572, 825.54, 340/825.3, 825.31, 825.34; 342/41, 44, 51

[56] References Cited

U.S. PATENT DOCUMENTS

| | | | |
|---|---|---|---|
| 4,196,418 | 4/1980 | Kip et al. | 340/825.31 |
| 4,333,072 | 6/1982 | Beigel | 340/825.54 |
| 4,364,043 | 12/1982 | Cole et al. | 340/825.54 |
| 4,471,345 | 9/1984 | Barrett, Jr. | 340/572 |
| 4,533,988 | 8/1985 | Daly et al. | 363/127 |
| 4,686,517 | 8/1987 | Fockens | 340/572 |
| 4,786,907 | 11/1988 | Koelle | 342/51 |
| 4,862,160 | 8/1989 | Ekchian et al. | 340/825.54 |
| 5,021,767 | 6/1991 | Fockens et al. | 340/572 |
| 5,081,458 | 1/1992 | Meunier | 342/44 |
| 5,103,222 | 4/1992 | Hogen Esch et al. | 340/825.54 |
| 5,105,190 | 4/1992 | Kip et al. | 340/825.54 |
| 5,276,430 | 1/1994 | Granovsky | 340/572 |
| 5,349,332 | 9/1994 | Ferguson et al. | 340/572 |
| 5,381,137 | 1/1995 | Ghaem et al. | 340/572 |
| 5,446,447 | 8/1995 | Carney et al. | 340/572 |
| 5,451,941 | 9/1995 | Lamazou et al. | 340/933 |
| 5,467,082 | 11/1995 | Sanderson | 340/825.54 |
| 5,471,196 | 11/1995 | Pilested | 340/572 |

*Primary Examiner*—Jeffery Hofsass
*Assistant Examiner*—Benjamin C. Lee
*Attorney, Agent, or Firm*—Robin, Blecker, Daley & Driscoll

[57] ABSTRACT

A multi-bit electronic article surveillance marker includes an antenna circuit and is powered by an interrogation field generated by EAS detection equipment and received by the marker's antenna circuit. The marker generates a multi-bit signal by selectively disturbing the interrogation field. The disturbances may be created by selectively short circuiting the marker's antenna circuit. All of the marker circuitry, including a coil that is part of the antenna circuit, may be provided as circuit elements formed on a semiconductor integrated circuit substrate.

4 Claims, 5 Drawing Sheets

MULTI-BIT EAS MARKER POWERED BY INTERROGATION SIGNAL IN THE EIGHT MHZ BAND

FIELD OF THE INVENTION

This invention relates to electronic article surveillance (EAS), and more particularly to EAS markers which receive power signals transmitted from interrogation equipment and provide multi-bit marker identification signals.

BACKGROUND OF THE INVENTION

It is well known to provide electronic article surveillance systems operating with "one-bit" EAS markers, i.e. markers whose presence can be detected by sensing equipment, but which otherwise provide no information. Such systems are widely used to prevent or deter unauthorized removal of items such as merchandise or library books from controlled premises.

It is desirable in some EAS applications to provide markers which are each capable of transmitting a unique multi-bit marker identification signal so that the presence of a particular item or individual associated with the marker can be detected. Systems using multi-bit markers for the purpose of controlling access to premises, or for keeping track of the locations of assets, have been proposed. In some cases, the proposed multi-bit markers are battery-powered, but providing a battery in the marker increases the cost of the system as well as the minimum size of the marker.

It has also been proposed to utilize active multi-bit markers that are powered by a field generated by detection equipment. For example, in the TIRIS system distributed by Texas Instruments, each marker includes a ferrite or wire coil antenna tuned to receive a power signal radiated by interrogation equipment at about 135 KHz. The marker also includes a storage capacitor which stores the received power signal and a memory which stores a unique multi-bit marker identification data word. The power signal also functions as an interrogation signal such that, when the storage capacitor is charged above a certain threshold, the marker automatically transmits a marker identification signal by radiating a frequency-shift keying data signal through the receiving antenna in accordance with the stored marker identification data.

It might be contemplated to operate field-powered active EAS markers at higher frequencies in order to increase the efficiency of power transfer to the marker so that the size of the antenna can be reduced and the range of operation increased. However, the use of a higher operating frequency also results in greater power consumption during transmission of the identification signal from the marker. As a result, in known toll road systems which operate at frequencies of several hundred megahertz to read tags provided on motor vehicles, either the tags include batteries or a narrowly focused power transmission beam is used. These tags also lack desirable features such as the ability to reprogram data stored in the tags.

Also, all existing multi-bit EAS systems utilize antenna structures that are too large for convenient attachment to many types of merchandise.

OBJECTS AND SUMMARY OF THE INVENTION

It is accordingly an object of the invention to provide a multi-bit EAS marker that is smaller in size than conventional multi-bit markers.

It is a further object of the invention to provide a field-powered multi-bit EAS marker that operates at a different frequency from conventional field-powered markers.

It is still a further object of the invention to provide an active EAS marker which operates with lower power consumption than conventional active markers.

It is yet another object of the invention to provide a multi-bit marker that can be applied to articles of merchandise in substantially the same manner as a price label.

According to a first aspect of the invention, there is provided an EAS marker that is responsive to an interrogation field signal generated by an electronic article surveillance system and includes a resonant circuit for electrically resonating at a predetermined resonant frequency in response to the interrogation field signal and a switch mechanism for selectively changing a resonance characteristic of the resonant circuit at times when the resonant circuit is exposed to the interrogation field signal. Further in accordance with this aspect of the invention, the switching mechanism may include a mechanism for selectively switching the resonant frequency of the resonant circuit or a mechanism for selectively short-circuiting the resonant circuit.

According to another aspect of the invention, there is provided an electronic article surveillance system which includes a generating circuit for generating an interrogation field signal, an EAS marker of the type described in the preceding paragraph, and a detection circuit for detecting fluctuations in the interrogation field signal caused by the selective changing of the resonance characteristic of the resonant circuit of the EAS marker.

According to still another aspect of the invention, there is provided an EAS marker that is responsive to an interrogation field signal generated by an electronic article surveillance system and includes a resonant circuit for electrically resonating in response to the interrogation field signal and a switch mechanism for selectively short-circuiting the resonant circuit at times when the resonant circuit is exposed to the interrogation field signal.

Further in accordance with the latter aspect of the invention, the marker may also include a power storage circuit for storing electrical energy induced in the resonant circuit by the interrogation field signal.

The marker, in accordance with this aspect of the invention, may also include a data storage circuit for storing and reading out a multi-bit data signal, with the switch mechanism being responsive to the multi-bit data signal read out from the data storage circuit so that the switch mechanism selectively short-circuits the resonant circuit in accordance with the read-out multi-bit data signal.

Further, in the EAS marker in accordance with this aspect of the invention, the resonant circuit may include an inductor and a capacitor, both of which are provided as circuit elements formed together on a semiconductor integrated circuit. Alternatively, the capacitor may be provided as a circuit element on a semiconductor integrated circuit and the inductor may be provided in the form of metal traces on a packaging structure for the integrated circuit.

As another alternative, the resonant circuit may include a coil formed of antenna wire.

In accordance with a further aspect of the invention, there is provided an electronic article surveillance system which includes generating circuitry for generating an interrogation field signal, an EAS marker exposed to the interrogation field signal and including a resonant circuit for electrically resonating in response to the interrogation field signal and a switch mechanism for selectively short-circuiting the resonant circuit, and detection circuitry for detecting fluctuations in the interrogation field signal caused by the selective short-circuiting of the resonant circuit of the EAS marker.

Further in accordance with the latter aspect of the invention, the generating circuitry may generate the interrogation field signal at a substantially constant predetermined frequency, with the resonant circuit of the EAS marker being resonant at the predetermined frequency. Alternatively, the interrogation field signal generated by the generating circuit may be swept through a predetermined frequency range according to a predetermined cyclic pattern, with the resonant circuit of the marker being resonant at a frequency within the predetermined frequency range.

According to still a further aspect of the invention, there is provided an EAS marker which includes a coil for receiving a power signal, a power storage circuit for rectifying and storing the power signal received by the coil, and a signal circuit for receiving power from the power storage circuit, and for generating a multi-bit marker identification signal which identifies the marker, the coil being tuned so as to be resonant at a selected frequency not lower than about 1 megahertz and not higher than about 20 megahertz. The selected frequency may be between 8 to 10 megahertz. Further, in accordance with this aspect of the invention, the power storage circuitry may include a storage capacitor and the coil may be tuned by means of a tuning capacitor. All of the coil, the storage capacitor, the tuning capacitor, and the signal circuitry may be formed as circuit elements on a single semiconductor integrated circuit.

According to still another aspect of the invention, there is provided an electronic article surveillance system which includes generating circuitry for transmitting a power signal, an EAS marker including a coil for receiving the power signal, power storage circuitry for rectifying and storing the power signal received by the coil, and signal circuitry for receiving power from the power storage circuitry, and for generating a multi-bit marker identification signal for identifying the marker, the coil being tuned so as to be resonant at a selected frequency not lower than about 1 megahertz and not higher than about 20 megahertz, and detection circuitry for receiving and detecting the multi-bit marker identification signal generated by the signal circuitry of the EAS marker.

According to yet another aspect of the invention, there is provided an EAS marker which includes a coil for receiving a power signal, a tuning capacitor connected across the coil for tuning the coil so that the coil is resonant at a selected frequency, a diode connected to the coil for rectifying the power signal received by the coil, a storage capacitor connected to the diode for storing the rectified power signal, a data circuit connected to the storage capacitor for receiving power from the storage capacitor, the data circuit being for storing and reading out multi-bit marker identification data, and a switch circuit, connected to the coil, for receiving the multi-bit marker identification data read out from the data circuit and for responding to the received identification data by selectively preventing the coil from receiving the power signal.

Further in accordance with this aspect of the invention, the switch circuit may be connected across the coil and may operate so as to selectively prevent the coil from receiving the power signal by selectively short-circuiting the coil.

According to a further aspect of the invention, there is provided an electronic article surveillance system that includes generating circuitry for transmitting a power signal, an EAS marker including a coil for receiving the power signal, a tuning capacitor connected across the coil for tuning the coil so that the coil is resonant at a selected resonant frequency, a diode connected to the coil for rectifying the power signal received by the coil, a storage capacitor connected to the diode for storing the rectified power signal, a data circuit connected to the storage capacitor for receiving power from the storage capacitor and for storing and reading out multi-bit marker identification data, and a switch circuit connected to the coil for receiving the multi-bit marker identification data read out from the data circuit and for responding to the received identification signal by selectively preventing the coil from receiving the power signal, and detection circuitry for sensing times when the switch circuit prevents the coil from receiving the power signal.

According to still another aspect of the invention, there is provided a semiconductor integrated circuit for use in an EAS marker, including a substrate and a plurality of circuit elements formed on the substrate, the circuit elements including a coil for receiving a power signal and a power storage circuit for rectifying and storing the power signal received by the coil.

Further in accordance with the latter aspect of the invention, the plurality of circuit elements formed on the substrate may include a data storage circuit which receives power from the power storage circuit and stores and reads out a multi-bit marker identification signal for identifying the EAS marker, and a switch circuit connected across the coil for selectively short-circuiting the coil in accordance with the multi-bit marker identification signal read out from the data storage circuit. The switch circuit may include a field effect transistor and the power storage circuit may include a storage capacitor and a diode connected between the coil and the storage capacitor.

According to a further aspect of the invention, there is provided an electronic article surveillance system, including generating circuitry for generating an interrogation field signal that is swept through a predetermined frequency range according to a predetermined cyclic pattern, first and second EAS markers simultaneously exposed to the interrogation field, with the first marker including a first resonant circuit for electrically resonating at a first predetermined frequency within the predetermined frequency range, first data storage means for storing and reading out a first multi-bit data signal, and first switch means responsive to the first multi-bit data signal read out from the first data storage means for selectively changing a resonance characteristic of the first resonant circuit in accordance with the read out first multi-bit data signal, and the second marker including a second resonant circuit for electrically resonating at a second predetermined frequency within the predetermined frequency range but different from the first predetermined frequency, a second data storage means for storing and reading out a second multi-bit data signal, and a second switch responsive to the second multi-bit data signal read out from the second data storage circuit for selectively changing a resonance characteristic of the second resonant circuit in accordance with the read out second multi-bit data signal, and with the system also including a detecting circuit for receiving the first and second multi-bit data signals by detecting respective fluctuations in the interrogation field signal caused by the selective changing of the resonance characteristics of the first and second resonant circuits. The second data signal may, but need not, be different from the first data signal.

According to still a further aspect of the invention, there is provided an EAS marker responsive to an interrogation field signal generated by an electronic article surveillance system, including a coil for receiving the interrogation field signal, and a switch for selectively short-circuiting the coil at times when the coil is exposed to the interrogation field signal.

According to yet a further aspect of the invention, there is provided a method of responding to an interrogation field signal generated by an electronic article surveillance system, including the steps of providing an EAS marker having a resonant circuit that electronically resonates at a predetermined resonant frequency in response to the interrogation field signal, and selectively changing a resonance characteristic of the resonant circuit at times when the resonant circuit is exposed to the interrogation field signal.

According to another aspect of the invention, there is provided a method of responding to an interrogation field signal generated by an electronic article surveillance system, including the steps of providing a coil for receiving the interrogation field signal, and selectively short-circuiting the coil at times when the coil is receiving the interrogation field signal.

According to yet another aspect of the invention, there is provided a method of operating an electronic article surveillance system, including the steps of generating an interrogation field signal, exposing to the interrogation field signal an EAS marker having a resonant circuit for electrically resonating in response to the interrogation field signal, selectively changing a resonance characteristic of the resonant circuit, and detecting fluctuations in the interrogation field signal caused by the selective changing of the resonance characteristic of the resonant circuit.

According to still another aspect of the invention, there is provided a method of operating an electronic article surveillance, including the steps of generating an interrogation field signal, exposing to the interrogation field signal an EAS marker having a coil for receiving the interrogation field signal, selectively short-circuiting the coil, and detecting fluctuations in the interrogation field signal caused by the selective short-circuiting of the coil.

The foregoing and other objects and features of the invention will be further understood from the following detailed description of preferred embodiments and from the drawings, wherein like reference numerals identify like components and parts throughout.

DESCRIPTION OF PREFERRED EMBODIMENTS

Figure 1:
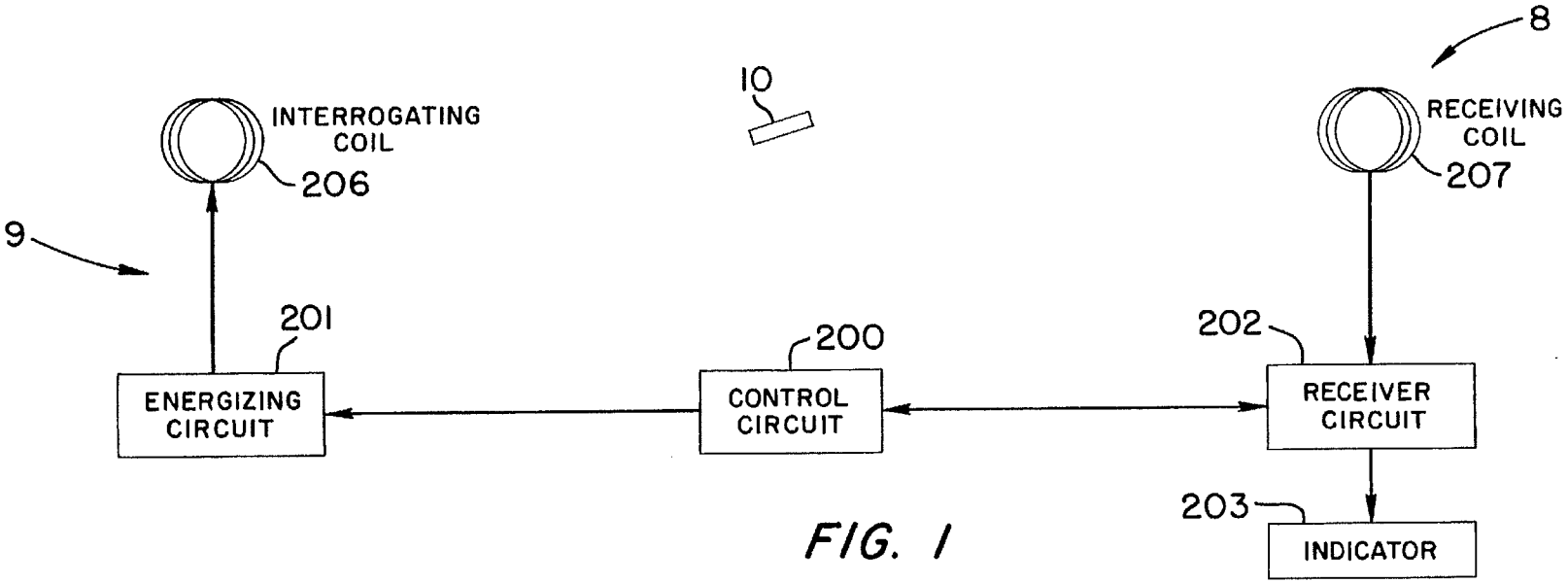
FIG. 1 is a block diagram of an electronic article surveillance system which operates with a high frequency field-powered multi-bit marker provided in accordance with the invention.

Preferred embodiments of the invention will now be described, initially with reference to FIG. 1. In FIG. 1, reference numeral 8 generally indicates an electronic article surveillance system provided in accordance with the invention. The EAS system 8 includes detection circuitry 9 which functions to detect the presence of an EAS marker 10, and which also functions to receive a multi-bit marker identification signal provided by the marker 10.

The detection equipment 9 is constituted by a control circuit 200 which controls operation of an energizing circuit 201 and a receiver circuit 202. Under the control of control circuit 200, the energizing circuit 201 generates an interrogation field signal which is radiated by an interrogating coil 206 to form an interrogation field. The receiver circuit 202 receives signals though a receiving coil 207. As will be discussed below, the marker 10 introduces disturbances in the interrogation field formed by the interrogating coil 206, and these field disturbances are detected by the receiver circuit 202. The disturbances introduced by the marker 10 preferably take the form of a multi-bit signal which is provided to the control circuit 200 through the receiver circuit 202. Although not separately shown in FIG. 1, the control circuit 200 may include, or may be interfaced with, circuitry for storing and forwarding marker identification signals received through the receiver circuit 202. Control circuit 200 may maintain a database of the respective occasions at which marker identification signals are received. The control circuit 200 may also be arranged to upload data to a host computer (not shown) in which such a database is to be maintained.

The detection circuitry 9 also includes an indicator 203 connected to the receiver circuit 202. The indicator 203 provides visual and/or audible indications at times when a marker 10 is detected through the receiver circuit 202 and/or when marker identification signals in a proper, predetermined format are detected. It should be understood that the indicator 203 may be dispensed with in cases where the system 8 is to be used only to maintain a record of movements of markers (and associated assets or individuals) and not to give immediate notice of unauthorized removal of assets or the like.

Figure 2:
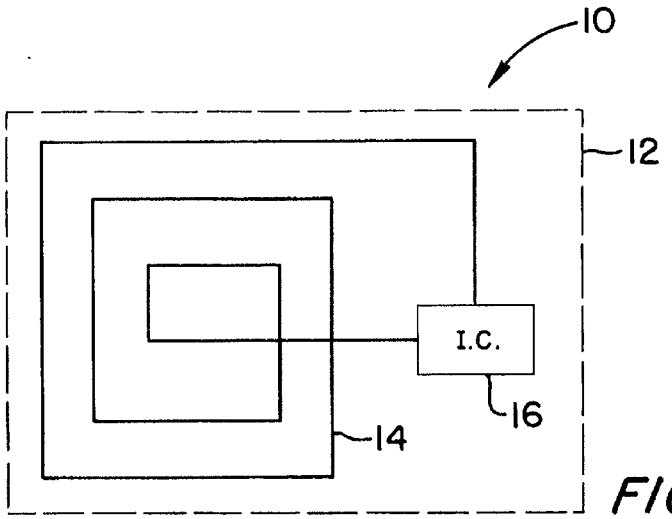
FIG. 2 is a schematic plan view of a first embodiment of a marker used in the system of FIG. 1.

A first embodiment of the marker 10 is shown in FIG. 2. The embodiment of FIG. 2 includes a body 12 made of plastic, or the like, that may be generally the same size and shape as a credit card. Embedded in the body 12 is a coil 14 formed of antenna wire. The coil 14 is connected to an integrated circuit 16 that is either mounted on, or embedded in, the body 12 of the marker 10.

Figure 3:
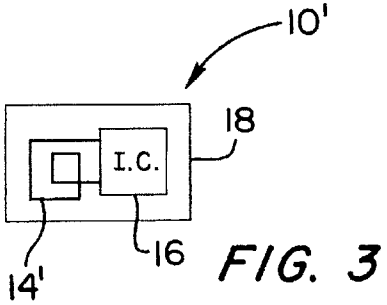
FIG. 3 is a schematic plan view of a second embodiment of a marker used in the system of FIG. 1.

Another embodiment of the marker is shown in FIG. 3 and indicated generally by reference numeral 10'. The marker 10' includes an integrated circuit 16 mounted according to a conventional technique on an integrated circuit packaging structure 18. A coil 14', connected to the IC 16, is provided in the form of metal traces deposited on the packaging structure 18. It will be recognized that the marker 10' is in a more compact form than the marker 10 shown in FIG. 2. However, for a given level of interrogation field signal generated by the detection equipment 9, it is likely that the distance at which the marker 10' can be properly detected would be shorter than the distance at which the marker 10 can be properly detected.

Figure 4A:
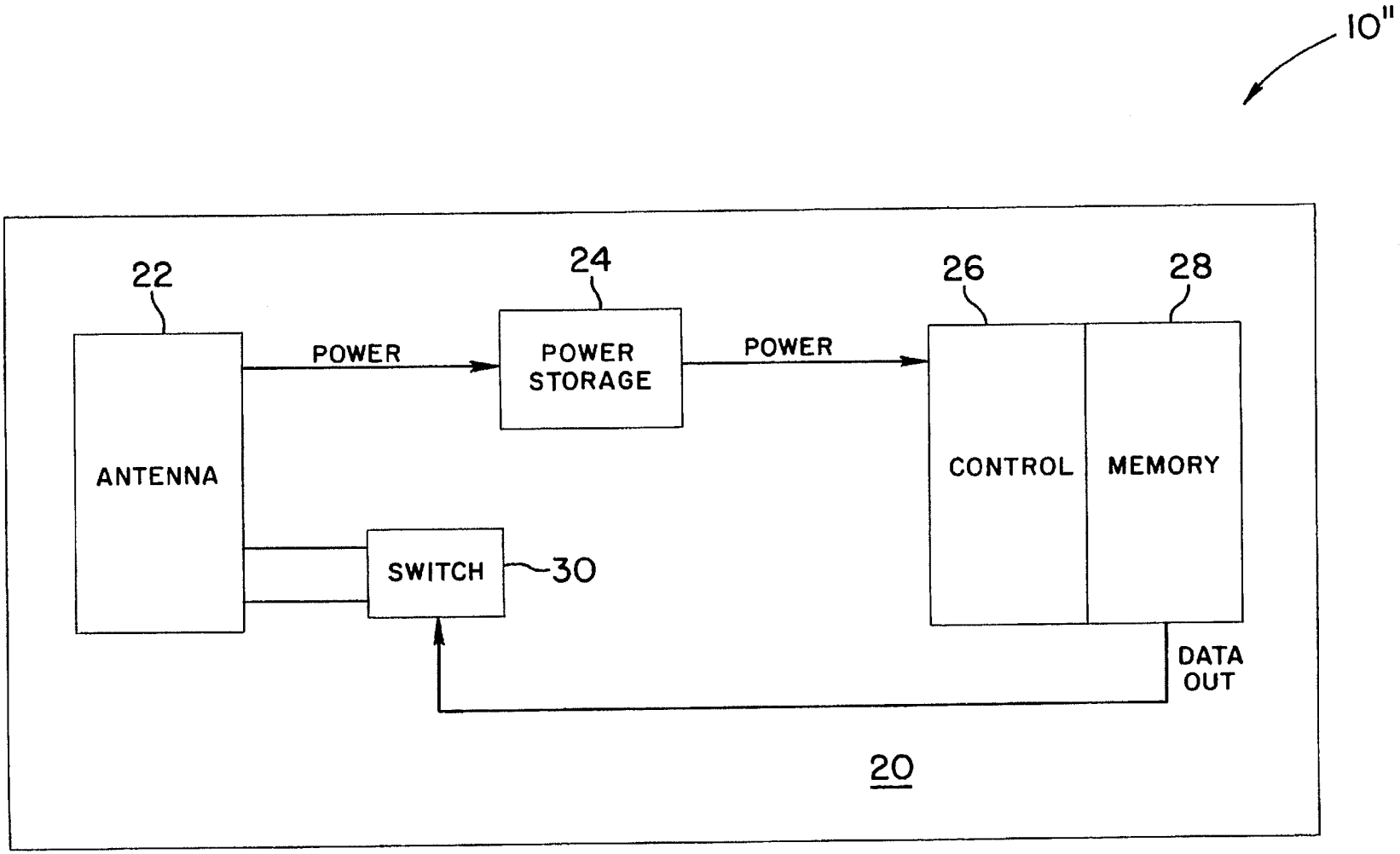
FIG. 4A is a schematic plan view of a third embodiment of a marker used in the system of FIG. 1.

A still more compact realization of the marker is shown in FIG. 4A and indicated generally by reference 10". It should be understood that FIG. 4A is presented on a larger scale than FIGS. 2 and 3.

The marker 10" of FIG. 4A includes a semiconductor substrate 20 upon which all of the circuit elements making up the marker, including the antenna coil, are formed. These circuit elements are indicated in summary block form in FIG. 4A as an antenna circuit 22, a power storage circuit 24, a control circuit 26, a memory circuit 28, and a switch circuit 30.

Figure 4D:
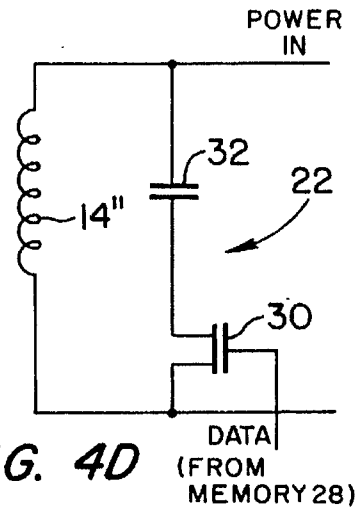
FIG. 4B illustrates in schematic form additional details of the marker embodiments shown in FIGS. 2, 3, and 4A.
FIG. 4C illustrates, in block diagram form, additional details of control and memory circuitry provided according to an embodiment of the marker circuit shown in FIG. 4B FIGS. 4D and 4E illustrate modifications that may be made to the circuit of FIG. 4B according to further respective embodiments of markers that may be used in the system of FIG. 1.
Figure 4E:
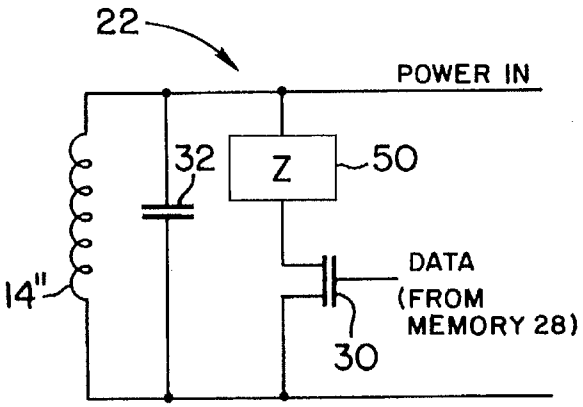
Figure 4B:
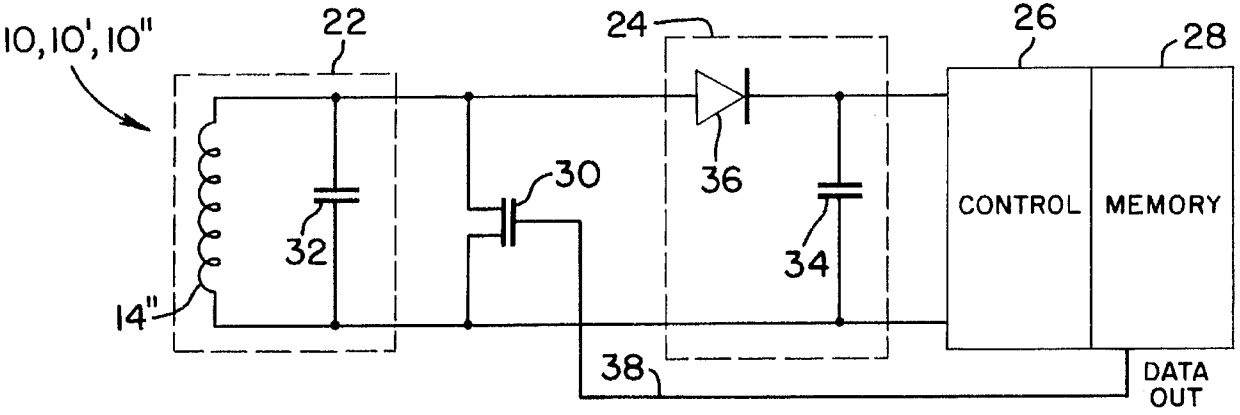

FIG. 4B is a partially schematic, partially block equivalent circuit representation of the circuit elements making up the marker 10". The antenna circuit 22, as shown in FIG. 4B, is constituted by a coil 14" and a tuning capacitor 32 connected in parallel with the coil 14" and selected so that the antenna circuit is resonant at a predetermined frequency. The switching circuit 30 is constituted by a field effect transistor connected in parallel with the coil 14" and capacitor 32. The power storage circuit 24 is constituted by a storage capacitor 34 and diode 36 connected between the capacitor 34 and the antenna circuit 22. The control circuit 26 and memory circuit 28 are connected to receive power from the storage capacitor 34. A data signal read out from the memory circuit 28 controls the FET 30 via a signal line 38 connected to the gate terminal of the FET.

It is also to be noted that the circuit representation of FIG. 4B also is representative of the circuitry of the marker embodiments shown in FIGS. 2 and 3, with all circuit elements other than the coil being constituted by the IC 16 shown in those drawing figures.

The three embodiments of the marker shown, respectively, in FIGS. 2, 3, and 4A, operate in the same manner, and differ principally in the form in which the antenna coil is provided. In the first embodiment (FIG. 2), the coil is provided in the form of antenna wire separate from and connected with the integrated circuit 16. In the second embodiment (FIG. 3), the coil again is separate from the IC 16, but is much smaller in physical dimension than the coil of FIG. 2, being provided as metal traces formed on the IC packaging. In the third embodiment the coil is smaller still, and is provided as part of the IC circuitry itself. The third embodiment (FIG. 4B), is sufficiently compact that the entire marker can be integrated with a price marking label for convenient application to articles of merchandise.

Operation of the marker and detection equipment disclosed herein will now be described, initially with reference with FIGS. 5A–5C.

Figure 5A:
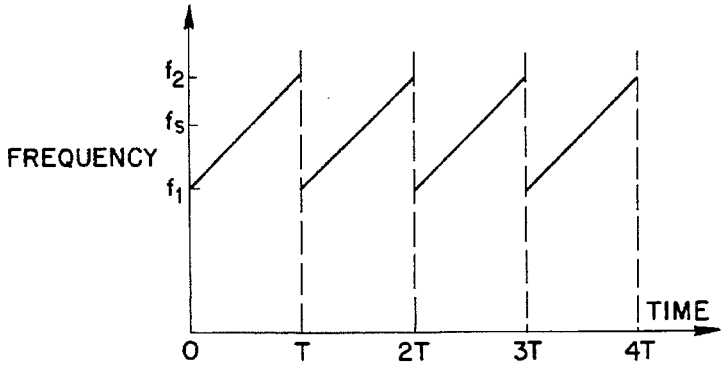
FIG. 5A is a graph which illustrates a frequency sweep cycle employed in generating an interrogation field signal in an embodiment of the EAS system of FIG. 1.

FIG. 5A graphically illustrates the nature of an interrogation field signal generated by the energizing circuit 201 and the interrogating coil 206 of a first embodiment of the detection equipment 9. The vertical axis in FIG. 5A represents the frequency of the interrogation field signal generated by the detection equipment, and the horizontal axis represents elapsed time. It will be observed that the interrogation field signal is swept through a frequency range $f_1$–$f_2$ according to a repetitive pattern, with each frequency sweep taking place within a time period T. A frequency $f_s$ which is within the frequency range $f_1$–$f_2$ is the selected resonant frequency of the antenna circuit 22 of the marker. The frequency range $f_1$–$f_2$ may, for example, be within the 8 Mhz–10 Mhz band which is available under FCC regulations. In particular, $f_1$ may be 8.2 Mhz, $f_2$ may be 9.8 MHz, and $f_s$ may be selected as 9 MHz. The sweep period T may be about 14.3 msec, resulting in a 70 Hz sweep cycle. (Of course, it is also contemplated to operate the system in other, and particularly in higher, frequency ranges, for example in a 30 MHz band, especially if permitted by changes in FCC regulations or in other regulatory environments.)

Figure 5B:
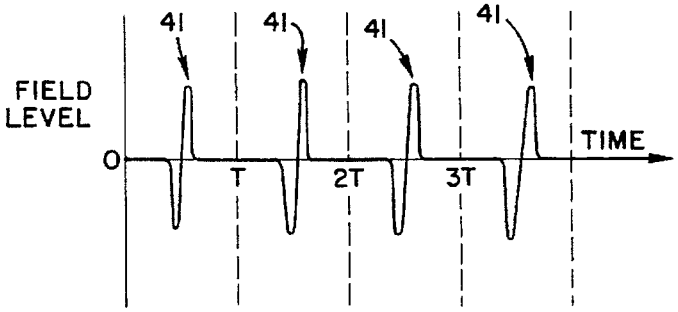
FIG. 5B is a graph which illustrates signals received in receiving circuitry of the EAS system which generates the interrogation field signal of FIG. 5A.

FIG. 5B is indicative of field signal levels as sensed through the receiving coil 207 and the receiver circuit 202. The receiver circuit 202 is arranged so that, when no marker is present, the detected field level is substantially flat and at a low level (effectively, zero).

On the other hand, when a marker is present, the detected field level includes marker response signals 41, shown in FIG. 5B, which include zero-crossings and are repeated in synchronism with the interrogation field signal cycle of FIG. 5A. During the negative leg of each pulse, the frequency of the interrogation field signal is less than the characteristic resonant frequency of the antenna circuit 22, and the antenna circuit oscillates with a phase delay relative to the interrogation field circuit, causing destructive interference. The phase delay and the degree of destructive interference is reduced as the interrogation field signal frequency approaches the resonant frequency of the antenna 22, until the interrogation field signal reaches the resonant frequency of the antenna 22, at which point a zero crossing occurs in the field level. Thereafter, as the frequency of the interrogation field signal increases above the resonant frequency of the antenna 22, the oscillation of the antenna 22 is advanced in phase relative to the interrogation field signal, resulting in increasing constructive interference. Accordingly, the presence of the marker can be detected by detecting repeated zero crossings at a period corresponding to the duration of the interrogation field signal sweep cycle.

Operation of the marker to generate a multi-bit marker identification signal will now be described. Energy transmitted by the detection circuit 9 in the form of the interrogation field signal is received via the antenna circuit 22, rectified by the diode 36 and stored at the capacitor 34. After a few sweep cycles during which the capacitor 34 is charged up, the control circuit 26 goes into operation to cause the memory circuit 28 to shift out, bit-by-bit, a previously stored multi-bit marker identification signal. The state of the bit signal shifted out onto line 38 controls whether the FET 30 is conducting or non-conducting, and accordingly controls whether the antenna circuit 22 is short circuited. For the purposes of the balance of the discussion, it will be assumed that a "0" data bit results in a short circuit and a "1" data bit causes the FET 30 to be non-conducting. However, it will be recognized that the bit polarity can easily be reversed.

Figure 5C:
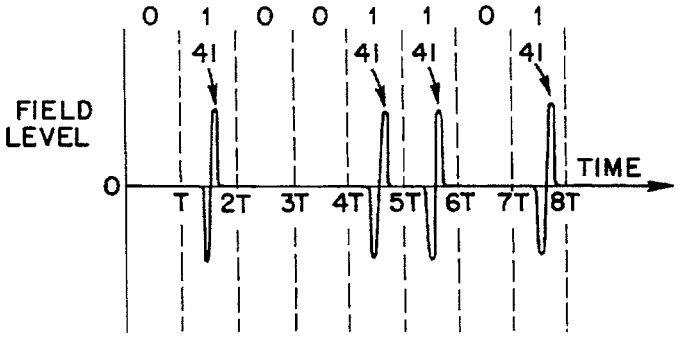
FIG. 5C is a graph which illustrates a marker identification data signal received in the receiving circuitry of the EAS system which generates the interrogation field signal illustrated in FIG. 5A.

As indicated in FIG. 5C (in which the time axis is compressed as compared to FIGS. 5A and 5B), for interrogation field signal sweep cycles in which a zero bit is asserted (shifted out by the memory) there is no zero crossing, whereas for interrogation fields signal sweep cycles corresponding to a "1" bit, there are zero crossings. Accordingly, the selective short-circuiting of the receiving antenna 22 in the marker causes disturbances in the signal as received at the receiving coil 207 and these disturbances are interpreted by the control circuit 200 as a bit pattern corresponding to the marker identification shifted out by the memory 28. In other words, the marker provided in accordance with the invention generates its marker signal by selectively interrupting reception of the power signal, rather than by generating and transmitting a separate signal. The inventive technique is advantageous in that it avoids the need to store and radiate the relatively large amount of power that would be required to generate and transmit a signal at the resonant frequency of the antenna circuit.

Another embodiment of the detection equipment 9 will now be described with reference to FIGS. 6A–6C. According to this embodiment, the interrogation field signal is not swept, but rather is maintained at a predetermined fixed frequency $f_s$ which is also the resonant frequency of the antenna circuit 22. The steady single-frequency interrogation field signal is graphically illustrated in FIG. 6A. It is to be noted that the frequency $f_s$, which is both the marker antenna resonant frequency and the field frequency, need not be the same as the resonant frequency $f_s$ referred to above in connection with FIGS. 5A–5C. For example, the frequency $f_s$ used in the embodiment of FIGS. 6A–6C may be any frequency in the 8–10 MHz band, or may be 13.2 MHz, which is another frequency available under FCC regulations.

Figure 6A:
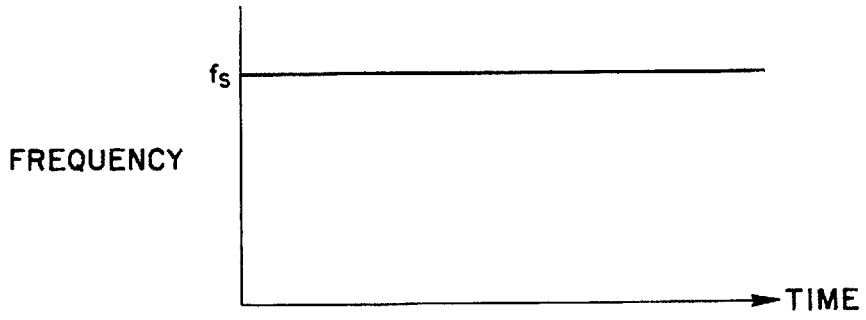
FIG. 6A is a graph which illustrates a constant frequency interrogation field signal generated by another embodiment of the EAS system of FIG. 1.
Figure 6B:
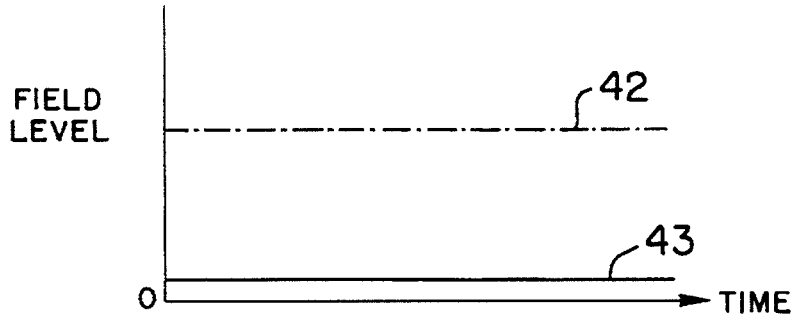
FIG. 6B is a graph which illustrates the signal received in receiving circuitry in the embodiment which generates the interrogation field signal illustrated in FIG. 6A.

The dot-dash line 42 in FIG. 6B indicates the constant and relatively high interrogation field signal level sensed via the receiving coil 207 and receiver circuit 202 in the absence of a marker. The relatively low but steady level of the sensed field signal, indicated by the solid line 43 in FIG. 6B, is sensed by the receiver circuit 202 when a marker is present and storing power from the interrogation field signal. As was the case in the embodiment discussed in connection with FIGS. 5A–5C, in the embodiment presently being discussed the marker operates to send a multi-bit marker identification signal by selectively short-circuiting its antenna circuit 22. As shown in FIG. 6C, "0" bit periods are produced when the FET 30 is in a conductive state so as to short-circuit the antenna circuit 22, while "1"-bit periods are produced by maintaining the FET 30 in a non-conductive state. Of course, as noted before, the bit polarity can easily be reversed. The bit period is indicated in FIG. 6C as being equal to a time T, which need not be the same as the period T shown in FIGS. 5A–5C.

Figure 6C:
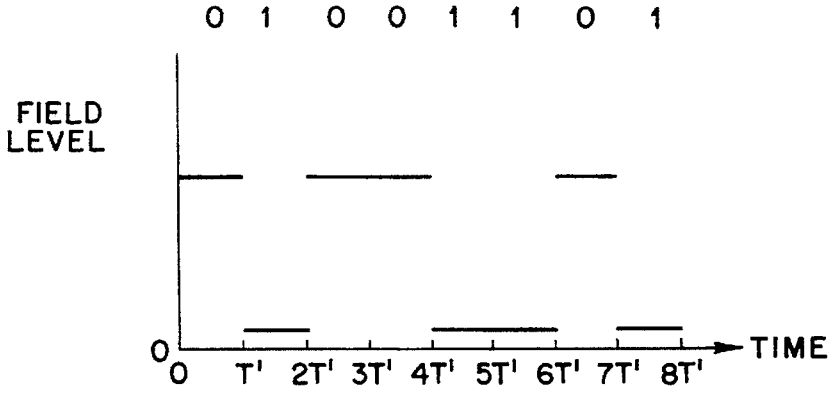
FIG. 6C is graph which illustrates a marker identification data signal received in the receiving circuitry of the EAS system which generates the interrogation field signal illustrated in FIG. 6A.

An advantage of the constant field embodiment described in connection with FIGS. 6A–6C is that there is considerable freedom in setting the data rate (bit rate), since the data rate does not need to be tied to an interrogation field sweep cycle. On the other hand, the absence of zero crossings in the sensed field level makes it difficult to detect the presence of a marker unless the marker is sending a bit pattern. Thus, the embodiment described in connection with FIGS. 6A–6C is not as readily adaptable to a "one-bit" marker application.

It should be understood that, in a marker which is operated with a swept-frequency system, the reading out of data bits should be synchronized with the frequency sweep cycle. This can be conveniently done by shifting out the next bit from the memory 28 (FIG. 4A) at a fixed delay (of less than the sweep period) after the power signal is received.

Figure 4C:
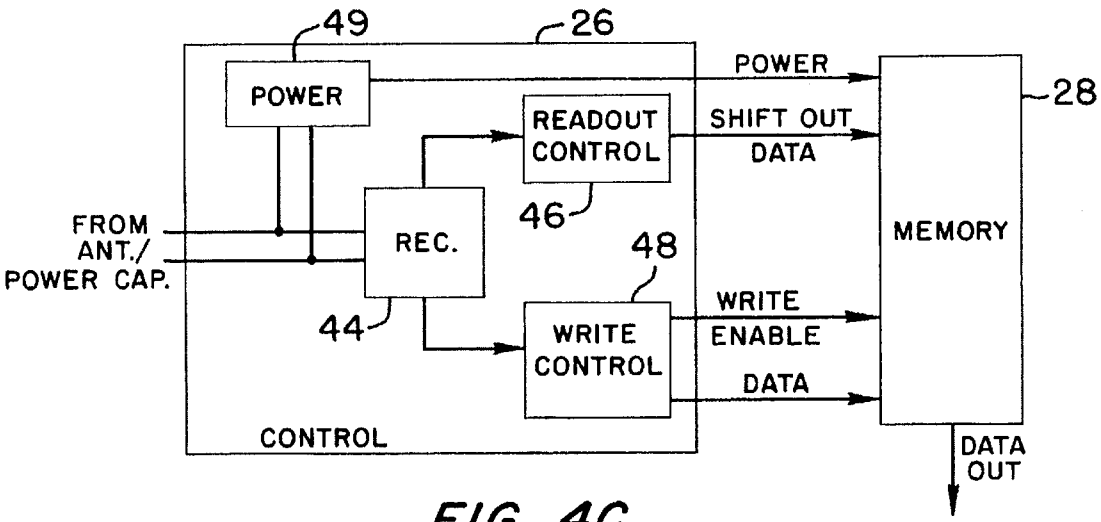

It is contemplated that the marker identification signal may either be permanently stored in the memory 28 (FIG. 4B) upon manufacturing the marker or that the identification signal may be writable and re-writable in the memory 28. An arrangement of the control circuit 26 and memory circuit 28 which allows the marker to receive a programming signal and to store a new marker identification signal included in the programming signal is shown in FIG. 4C. As indicated in FIG. 4C, the control circuit 26 includes a receiver block 44, a readout control block 46, a write control block 48 and a power conditioning block 49.

The power conditioning block 49 provides power to the other components of the control circuit 26 (through connections which are not shown) and also to the memory circuit 28.

The receiver block 44 is connected to receive the interrogation field signal and/or a programming signal via the antenna circuit 22. The interrogation field signal may be modulated according to known techniques to provide a programming signal including a predetermined bit pattern to indicate that programming of the marker is to be performed, followed by a bit pattern representing the new marker identification signal to be stored in the memory 28. The programming signal may be provided by operating the detection equipment 9 to modulate the interrogation field signal so as to produce the programming signal, or may be provided by dedicated programming signal generating equipment (not shown). The control circuit 26 may be arranged so that data is shifted out of the memory 28 in response to a non-modulated interrogation field signal. Alternatively, when the detection equipment 9 is to be operated in its normal mode for detecting markers, the interrogation field signal may be modulated by a marker detection bit pattern, different from the bit pattern which indicates a programming signal. Then, the control circuit 26 responds to the marker detection bit pattern by shifting out the marker identification signal. In either case, upon receipt of an appropriate interrogation signal via the receiver block 44, the readout control block 46, in response to a signal from the receiver block 44, provides a signal to the memory 28 to cause the marker identification signal currently stored in the memory 28 to be shifted out, bit-by-bit, as previously described in connection with FIG. 4B.

When a programming signal is received at the receiver block 44, the receiver block 44 provides suitable control signals to the write control block 48 so that the write control block 48 provides a write enable signal to the memory 28 and also provides data (preferably in serial form) so that the new marker identification signal is stored in the memory 28.

It will be recalled that the marker circuitry described in connection with FIG. 4B operated to generate a marker identification signal in the form of disturbances in the interrogation field signal level by selectively short-circuiting the antenna circuit 22. However, the present invention contemplates other arrangements by which the interrogation field may by selectively disturbed so as to generate a bit pattern. For example, the coil 14", tuning capacitor 32 and FET switch 30 may be rearranged as in FIG. 4D. In the arrangement of FIG. 4D, it will be understood that the FET 30 is normally maintained in a conductive condition, but is selectively rendered non-conductive in response to the data signal shifted out from the memory 28. As a result, the tuning capacitor 32 is selectively removed from the antenna circuit, thereby selectively detuning the antenna circuit in order to produce disturbances in the interrogation field.

According to another arrangement, shown in FIG. 4E, a circuit element such as an inductance, capacitance, or resistance (represented by impedance 50 in FIG. 4E) is selectively switched into a parallel connection with the tuning capacitor 32 for the purpose of selectively detuning the antenna circuit 22.

It is also contemplated to modify the marker embodiment shown in FIG. 4B by omitting the tuning capacitor 32 shown as part of the antenna circuit 22. This may be done because the coil 14" is arranged to be resonant without a separate capacitor, or, in the case of a non-resonant coil, if it is acceptable to forego the efficiencies provided by a resonant antenna circuit. In the latter case, it is to be understood that single frequency operation, as shown in FIGS. 6A–6C, would be contemplated. However, it can be expected that selective shorting of the non-resonant antenna coil in this embodiment would provide a smaller difference between the '0' and '1' bit field levels than that shown in FIGS. 6B and 6C.

Considering again the swept-frequency embodiment of the EAS system, as described in connection with FIGS. 5a–5C, it is contemplated to modify this embodiment so that it is capable of simultaneously receiving marker identification signals from more than one marker. According to this modified embodiment, markers are provided which have mutually different resonant frequencies $f_{s1}, f_{s2}, \ldots, F_{sN}$, all within the frequency range $f_1$–$f_2$. When one of these markers is within the interrogation field, and its antenna circuit 22 is not short circuited, the receiver circuit will detect zero crossings in synchronism with the interrogation signal sweep cycle. Moreover, the point in time within each sweep cycle at which the zero crossing takes place will be dependent on the resonant frequency of the marker.

Figure 7A:
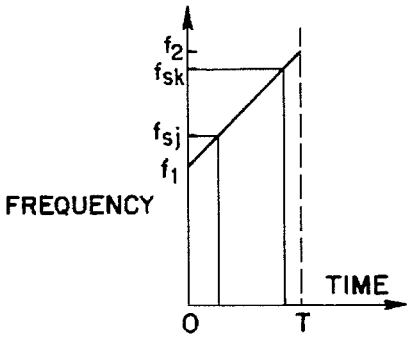
FIGS. 7A and 7B graphically illustrate operation of an embodiment of a swept-frequency EAS system operated with markers having different respective resonant frequencies.
Figure 7B:
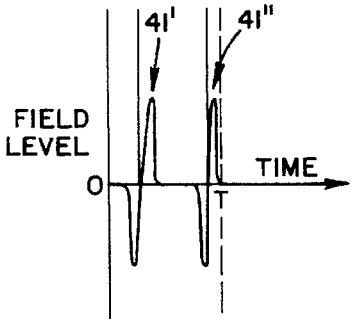

In other words, considering two markers having the respective resonant frequencies $f_{sj}$ and $f_{sk}$, with $f_1<f_{sj}<f_{sk}<f_2$ (see FIG. 7A), it will be appreciated that a marker response signal 41' (FIG. 7B) resulting from the marker resonant at $f_{sj}$ will occur earlier in the sweep cycle than the marker response signal 41" resulting from the marker resonant at $f_{sk}$. Accordingly, in order for the system to detect the respective identification signals of two markers simultaneously present in the interrogation field, the receiver 202 and/or the control circuit 200 are arranged to detect not only the presence or absence of zero crossings in a given sweep cycle, but also the timing at which the zero crossing occurs within the sweep cycle. The system can then distinguish between zero crossings ("1" bits) asserted by different markers. When two different markers are present and each asserts a "1" bit during the same sweep cycle, two zero crossing occur at different times in the cycle (as illustrated in FIG. 7B) and are separately detected by the system. In this way, two (or more) markers can be separately and simultaneously read by the system, based on the different points in the sweep cycle at which zero-crossings are detected.

Various changes to the foregoing electronic surveillance systems and markers may be introduced without departing from the invention. The particularly preferred embodiments are thus intended in an illustrative and not limiting sense. The true spirit and scope of the invention is set forth in the following claims.

What is claimed is:

1. An electronic article surveillance system, comprising:

generating means for generating an interrogation field signal that is swept through a predetermined frequency range according to a predetermined cyclic pattern;

first and second EAS markers simultaneously exposed to said interrogation field; the first marker including a first resonant circuit for electrically resonating at a first predetermined frequency within said predetermined frequency range, first data storage means for storing and reading out a first multi-bit data signal, and first switch means responsive to said first multi-bit data signal read out from said first data storage means for selectively changing a resonance characteristic of said first resonant circuit in accordance with said read out first multi-bit data signal; the second marker including a second resonant circuit for electrically resonating at a second predetermined frequency within said predetermined frequency range but different from said first predetermined frequency, a second data storage means for storing and reading out a second multi-bit data signal, and second switch means responsive to said second multi-bit data signal read out from said second data storage means for selectively changing a resonance characteristic of said second resonant circuit in accordance with said read out second multi-bit data signal; and detecting means for receiving the first and second multi-bit data signals by detecting respective fluctuations in said interrogation field signal caused by the selective changing of the resonant characteristics of the first and second resonant circuits.

2. An electronic article surveillance system according to claim 1, wherein said first switch means operates to selectively change said resonance characteristic of said first resonant circuit by short-circuiting said first resonant circuit, and said second switch means operates to selectively change said resonance characteristic of said second resonant circuit by short-circuiting said second resonant circuit.

3. An electronic article surveillance system according to claim 1, wherein the first EAS marker includes a first power storage means for storing electrical energy induced in said first resonant circuit by said interrogation field signal and the second EAS marker includes a second power storage means for storing electrical energy induced in said second resonant circuit by said interrogation field signal.

4. An electronic article surveillance system according to claim 1, wherein said second multi-bit data signal is different from said first multi-bit data signal.

* * * * *